US009852596B2

(12) United States Patent
Alexis

(10) Patent No.: US 9,852,596 B2
(45) Date of Patent: Dec. 26, 2017

(54) SECURITY TAG AND METHOD OF USING SAME TO FACILITATE AUTHORIZED REMOVAL OF INVENTORY ITEMS FROM CONTROLLED AREAS

(71) Applicant: Mark D. Alexis, Wellington, FL (US)

(72) Inventor: Mark D. Alexis, Wellington, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 85 days.

(21) Appl. No.: 14/827,386

(22) Filed: Aug. 17, 2015

(65) Prior Publication Data

US 2017/0053506 A1 Feb. 23, 2017

(51) Int. Cl.
*G08B 13/14* (2006.01)
*G08B 13/24* (2006.01)

(52) U.S. Cl.
CPC ..... *G08B 13/2434* (2013.01); *G08B 13/246* (2013.01)

(58) Field of Classification Search
CPC ..... G08B 13/242; G08B 13/2411
USPC ..... 340/568.1, 572.3, 572.9
See application file for complete search history.

(56) References Cited

U.S. PATENT DOCUMENTS 5,426,419 A 6/1995 Nguyen et al.
5,528,914 A 6/1996 Nguyen et al.
5,535,606 A 7/1996 Nguyen et al.
5,640,002 A * 6/1997 Ruppert ..... G06K 7/0008 235/383
5,942,978 A 8/1999 Shafer
5,955,951 A 9/1999 Wischerop et al.
7,907,732 B2 * 3/2011 Yarvis ..... G07C 9/00111 340/568.1
2003/0234288 A1 * 12/2003 Canipe ..... G06K 7/10 235/383
2010/0148962 A1 * 6/2010 Nguyen ..... E05B 73/0017 340/572.1

(Continued)

FOREIGN PATENT DOCUMENTS

GB 2503720 A 1/2014

OTHER PUBLICATIONS

PCT International Search Report and Written Opinion of the International Searching Authority (EPO) for International Application No. PCT/US2016/047376 dated Oct. 18, 2016.

*Primary Examiner* — Kevin Kim
(74) *Attorney, Agent, or Firm* — Fox Rothschild LLP; Robert J. Sacco; Carol E. Thorstad-Forsyth

(57) ABSTRACT

Security tag and method of using same facilitates authorized removal of items from a controlled area where the items have been marked with an item identification code. The method involves providing a transaction software application to facilitate use of a PMCD to obtain the item identification code and participate in a wireless communication session with a transaction server to receive an authorization for release of the item from the controlled area. The application uses the PMCD to access from the security tag certain security tag information available from the security tag. The security tag information is used at the PMCD to determine an unlock code for the security tag. The PMCD is then used to wirelessly communicate the unlock code to the security tag after the authorization for release has been received.

13 Claims, 6 Drawing Sheets

(56) References Cited

U.S. PATENT DOCUMENTS

| | | | | |
|---|---|---|---|---|
| 2010/0188227 | A1* | 7/2010 | Yang | G08B 13/1463 340/572.1 |
| 2012/0112912 | A1* | 5/2012 | Berg | G08B 13/2411 340/572.3 |
| 2014/0055264 | A1* | 2/2014 | Valiulis | G08B 13/14 340/568.1 |
| 2014/0091932 | A1* | 4/2014 | Mohiuddin | G08B 13/246 340/572.1 |
| 2015/0302711 | A1* | 10/2015 | Yang | E05B 73/0029 340/572.9 |

* cited by examiner

SECURITY TAG AND METHOD OF USING SAME TO FACILITATE AUTHORIZED REMOVAL OF INVENTORY ITEMS FROM CONTROLLED AREAS

BACKGROUND OF THE INVENTION

Electronic Article Surveillance ("EAS") systems are often used by retail stores in order to minimize loss due to theft. One common way to minimize retail theft is to attach a security tag to an article such that an unauthorized removal of the article can be detected. In some scenarios, a visual or audible alarm is generated based on such detection. For example, a security tag with an EAS element (e.g., an acousto-magnetic element) can be attached to an article offered for sale by a retail store. An EAS interrogation signal is transmitted at the entrance and/or exit of the retail store. The EAS interrogation signal causes the EAS element of the security tag to produce a detectable response if an attempt is made to remove the article without first detaching the security tag therefrom. The security tag must be detached from the article upon purchase thereof in order to prevent the visual or audible alarm from being generated.

One type of EAS security tag can include a tag body which engages a tack. The tack usually includes a tack head and a sharpened pin extending from the tack head. In use, the pin is inserted through the article to be protected. The shank or lower part of the pin is then locked within a cooperating aperture formed through the housing of the tag body. In some scenarios, the tag body may contain a Radio Frequency Identification ("RFID") element. The RFID element can be interrogated by an RFID reader to obtain RFID data therefrom.

The EAS security tag may be removed or detached from the article using a detaching unit. Examples of such detaching units are disclosed in U.S. Pat. No. 5,426,419 ("the '419 patent), U.S. Pat. No. 5,528,914 ("the '914 patent"), U.S. Pat. No. 5,535,606 ("the '606 patent"), U.S. Pat. No. 5,942,978 ("the '978 patent") and U.S. Pat. No. 5,955,951 ("the '951 patent"). The detaching units disclosed in the listed patents are designed to operate upon a two-part hard EAS security tag. Such an EAS security tag comprises a pin and a molded plastic enclosure housing EAS marker elements. During operation, the pin is inserted through an article to be protected (e.g., a piece of clothing) and into an aperture formed through at least one sidewall of the molded plastic enclosure. The pin is securely coupled to the molded plastic enclosure via a clamp disposed therein. The pin is released by a detaching unit via a probe. The probe is normally retracted within the detaching unit. Upon actuation, the probe is caused to travel out of the detaching unit and into the enclosure of the EAS security tag so as to release the pin from the clamp or disengage the clamp from the pin. Once the pin is released from the clamp, the EAS security tag can be removed from the article.

While EAS security tags do help reduce retail theft, their use requires customers to wait in lines to complete purchases, because the tag must be removed so as not to trigger an EAS security alarm when leaving the store.

SUMMARY OF THE INVENTION

This disclosure concerns implementing systems and methods for security tag detachment or deactivation authorization. According to one aspect, the invention concerns a method to selectively facilitate the authorized removal from a controlled area of items which have been marked with an item identification code. In an exemplary arrangement, the item identification code can be a Universal Product Code (UPC) or Electronic Product Code (EPC) associated with the item.

The method involves attaching to each item which is disposed in the controlled area a security tag detectable by an Electronic Article Surveillance (EAS) system. A transaction software application is provided for one or more portable mobile communication devices (PMCDs). The transaction software application is operable to facilitate use of the PMCD to obtain the item identification code and participate in a wireless communication session with a transaction server to receive an authorization for release of the item from the controlled area. For example, the wireless communication session may comprise a purchase transaction in which the PMCD is used to facilitate purchase of the item.

The transaction software application is further operable to facilitate use of the PMCD to access from the security tag certain security tag information which is available on or in the security tag. The transaction software causes the PMCD to use the security tag information to compute an unlock code for the security tag. In some embodiments, the unlock code is encrypted as a security measure. The transaction software application is further arranged to facilitate use of the PMCD to wirelessly communicate the unlock code to the security tag after the authorization for release has been received. The security tag is responsive to receipt of the unlock code to unlock a locking mechanism in the security tag or deactivate the security tag.

According to one aspect, the security tag information is accessed by the PMCD from the security tag by using an imaging device of the PMCD to scan a barcode disposed on an exterior housing of the security tag. Thereafter, the unlock code is wirelessly communicated to the security tag using an optical communication link. The optical communication link advantageously makes use of hardware elements which are commonly found on conventional PMCDs. For example, the PMCD can make use of a user interface display device or an optical emitter (a camera flash element) disposed on the PMCD to communicate the encrypted unlock code to the security tag. In certain scenarios, the security tag information is accessed by the PMCD from the security tag using a short range wireless communication protocol instead of the optical scanning method.

According to a further aspect, the security tag information is chosen to be a public key. In such a scenario, the PMCD uses the public key to compute the encrypted unlock code. The encrypted unlock code thereafter is decodable by the security tag from which security tag information was obtained by using a private key which is stored in the security tag.

The invention also concerns a security tag for an Electronic Article Surveillance (EAS) system. A security tag includes a security tag housing and a barcode visibly disposed on exterior of the security tag housing specifying security tag information. At least one EAS detection element is disposed within the security tag housing. The EAS detection element is responsive to an EAS system interrogation signal for producing a detectable electromagnetic signature when the security tag is present within an EAS detection zone. Also disposed within the security tag housing is a computer processing device and a wireless communication receiver operatively coupled to the computer processing device. The computer processing device is responsive to a coded signal determined in accordance with the security tag information and received using the wireless communication receiver to perform at least one security tag action. In some embodiments, the coded signal can be encrypted using a public key specified by the security tag information. In that case, the security tag advantageously includes a private key stored in a data memory of the security tag to decrypt the coded signal.

According to one aspect, the security tag includes a latch release mechanism that is responsive to the computer processing device. In such a scenario, the security tag action may comprise transitioning the latch release mechanism to an unlatched state to facilitate release of the security tag from an article. The computer processing device can be further arranged to cause the latch release mechanism to remain in the unlatched state for a predetermined period of time before automatically causing the latch release mechanism to revert to a latched state. According to a further aspect, the EAS detection element is configured to be selectively disabled responsive to the computer processing device. In such a scenario, the security tag action can comprise disabling the EAS detection element to facilitate the removal of the security tag from an EAS controlled area without setting off an EAS alarm.

The wireless communication receiver incorporated into the security tag is advantageously selected to be an optical receiver that is operable for receiving the coded signal in an optical format. Also, the security tag can include at least one of an optical emitter and an audio annunciator which are responsive to the computer processing device. The computer processing device is advantageously configured to use at least one of the optical emitter and the audio annunciator to signal that the at least one security tag action has been performed.

According to a further aspect, the security tag for an Electronic Article Surveillance (EAS) system as described herein can comprise a security tag information dissemination device which is configured to facilitate short range wireless communication of the security tag information to a PMCD. The security tag can be similar to the security tag described above. But information dissemination device can be a barcode affixed to an exterior of a housing of the security tag as described above, or can be a near field communication wireless radio frequency communication device.

DESCRIPTION OF THE DRAWINGS

Embodiments will be described with reference to the following drawing figures, in which like numerals represent like items throughout the figures, and in which.

DETAILED DESCRIPTION OF THE INVENTION

Figure 1:
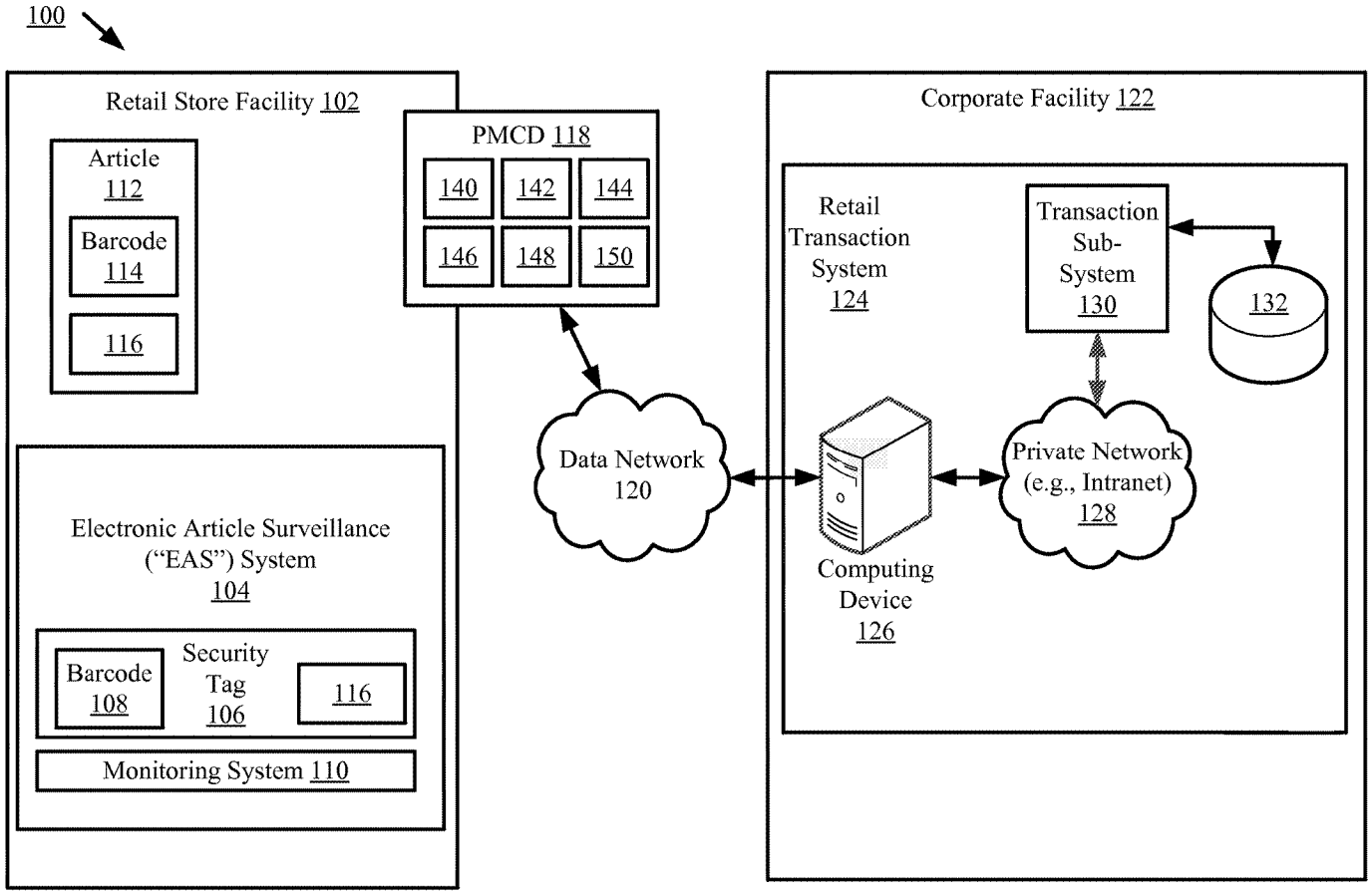
FIG. 1 is an illustration of an exemplary architecture for a security tag detachment method and system which permits customers to use their portable mobile communication devices to perform security tag unlocking operations.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Mobile shopping apps, shopping websites and self-checkout solutions are becoming more prevalent in retail stores. A mobile shopping app allows a customer to complete a purchase transaction using their personal mobile communication device (PMCD) such as a smart phone. Presently, there is no way for a retail store to provide a customer with authorization to detach and/or deactivate security tags attached to protected retail items after they customer completes a purchase using their PMCD. Accordingly when a customer uses their PMCD for to complete a mobile shopping app purchase, the security tags attached to the purchased products will trigger an alarm at a retail store's exit. For tag deactivation, some retailers have a deactivation device tied to a fixed POS. Deactivation of a security tag is only enabled when there is a scanned UPC. However, there is no verification that the correct security tag is deactivated.

The systems and methods discussed herein facilitate security tag detachment/deactivation by a customer using their PMCD after using the PMCD to complete a successful purchase transaction. Accordingly, the present solution facilitates the use of mobile shopping applications and self-checkout solutions in retail establishments that would not otherwise be possible due to the use of security tags. The present solution provides advantages to retailers by (1) reducing labor costs for checkout and security tag detachment/deactivation and (2) allowing better management of customers due to mobile checkout options available. The present solution also provides advantages to customers by (1) allowing customers to self-pay using a mobile shopping applications and self-checkout solutions in store with products protected by security tags. As such, there is no need for the customers to stand and wait in checkout lines.

A mobile shopping app which has been downloaded to a PMCD enables the scanning of Universal Product Code (UPC) or Electronic Product Code (EPC) associated with the product. As is known, a UPC is a barcode symbology (i.e., a specific type of barcode) that is widely used for tracking trade items in stores. If a conventional UPC is utilized, the UPC bar code can be printed on a label or tag attached to the physical object or trade item being identified. If an EPC solution is used, the EPC information can be encoded in an RFID tag that uniquely identifies the product by including the EPC. In some scenarios, the RFID tag may be incorporated into the security tag as a dual technology tag for a single security tag option or as a separate tag on the product. The dual technology security tag may have a barcode identifying the encoded EPC. Alternatively or additionally, the EPC may be encoded in a way where the UPC is included in the EPC.

Exemplary Systems

Referring now to FIG. 1, there is provided a schematic illustration that is useful for understanding the inventive arrangements. An exemplary anti-theft system 100 comprises a retail store facility 102 including an EAS system 104. The EAS system 104 comprises a monitoring system 110 and at least one security tag 106. Although not shown in FIG. 1, the security tag 106 is attached to an article 112, thereby protecting the article 112 from an unauthorized removal from the retail store facility 102. The monitoring system 110 establishes a surveillance zone (not shown) within which the presence of the security tag 106 can be detected. The surveillance zone is established at an access point (not shown) for the retail store facility 102. If the security tag 106 is carried into the surveillance zone, then an alarm is triggered to indicate a possible unauthorized removal of the article 112 from the retail store facility 102.

During store hours, a customer (not shown) may desire to purchase the article 112 using their PMCD 118. The PMCD 118 is a handheld communication device running the retail transaction application. The handheld communication device can be, but is not limited to, a cellular phone, a smart phone, a portable computer, a tablet, or a personal digital assistant. PMCDs are well known in the art and therefore will not be described here in detail. However, it will be appreciated that a PMCD 118 can include a processing element 140 such as a microprocessor, a data store 142 for storing computer data and one or more application programs carrying out the various processes described herein, a graphical display device 144 for displaying information to a user, and a user input element for receiving user inputs to the PMCD. The user input element can be a keypad (not shown) or may be combined with the graphical display device 144 if a touch screen display is used for such purpose. The PMCD 118 also includes an imaging device 146 (e.g. a camera) that is capable of scanning a barcode, a light emitting device 148 (such as an LED used for camera flash and/or illumination). Finally, the PMCD can include one or more radio frequency communication hardware entities 150 which facilitate radio frequency communications as described herein. Exemplary radio frequency communications protocols implemented by the PMCD 118 can include wireless cellular data communications and wireless network communications. The wireless network communications protocols can be implemented in accordance with various well-known standards such as IEEE 802.11, Bluetooth and Near Field Communication protocols.

According to one aspect of the inventive arrangements, the customer can purchase the article 112 using the PMCD 118 when the customer and PMCD 118 are present within the retail store facility 102. To begin a purchase transaction, the retail transaction application is launched on the customer's PMCD 118. The launch process can be started simply by performing a user software interaction, such as depressing a key on a keypad of the PMCD 118 or touching a button on a touch screen display of the PMCD 118. Once launched, the retail transaction application can wait for a further user input indicating that the user wishes to complete a purchase transaction.

To begin the purchase of article 112, a retail transaction application executing on the PMCD 118 facilitates an exchange of data by which the PMCD receives UPC and/or EPC information pertaining to the article 112. For example, if a UPC tag is provided on the article 112 the PMCD can use an imager or camera provided as part of the PMCD 118 to optically scan a barcode 114 containing the UPC information.

In the barcode scenario, the article 112 has a barcode 114 attached to an exposed surface thereof. The term "barcode", as used herein, refers to a pattern or symbol that contains embedded data. Barcodes may include, for example, one-dimensional barcodes, two dimensional barcodes (such as matrix codes, Quick Response ("QR") codes, Aztec codes and the like), or three-dimensional bar codes. The embedded data can include, but is not limited to, a unique identifier of the article 112. The barcode 114 is read by using an imager/camera (not shown in FIG. 1) that is provided as part of the PMCD. Barcode scanners/reader software is well known in the art and therefore will not be described here in detail. In an alternative embodiment, the article information such as an EPC or UPC can be communicated from the article 112 to the PMCD 118 by means other than optical scanning. For example, a wireless communication, such as a Near Field Communication ("NFC"), could be used for this purpose.

After the customer has used the PMCD 118 to acquire the UPC or EPC information they may optionally manually input additional data into the retail transaction application to facilitate a purchase transaction. Such additional data can include any information that is useful for purchasing the article 112. Alternatively, the user may use a keypad or touchscreen of the PMCD to manually input the UPC or EPC information.

After the customer has used the PMCD to obtain the article information for an article 12 that they wish to purchase, payment information is input into the retail transaction application of the PMCD 118. The payment information can include, but is not limited to, a customer loyalty code, payment card information, and/or payment account information. The payment information can accessed from a data store (not shown) that is associated with the PMCD. Alternatively, the payment information can be input to the PMCD using suitable automated means. Exemplary methods can involve the use of optical scanning devices, cameras, imagers, barcode readers and electronic card readers without limitation. Electronic card readers and barcode readers are well known in the art, and therefore will not be described herein. Any known or to be known automated system for acquiring the payment information can be used without limitation. The payment information can alternatively or additionally be obtained from a remote data store based on a customer identifier or account identifier. In this case, the payment information can be retrieved from stored data associated with a previous sale of an article to the customer.

Upon obtaining the payment information, the PMCD 118 automatically performs operations for establishing a retail transaction session with the Retail Transaction System ("RTS") 124. RTS 124 is part of a corporate facility 122. The RTS 124 can be located at the retail store facility 102 or can be at a location that is remote from the retail store facility 102.

The retail transaction session can involve communicating the article information and payment information from the PMCD 118 to the RTS 124 via a data network 120. The data network can be comprised of a single network or a plurality of interconnected computer data networks. For example, in some scenarios the data network 120 can be comprised of a local wireless computer data network maintained within the retail store facility 102. But in other scenarios, the data network 120 can include a wireless cellular data network (not shown). The data network 120 can also comprise a network of networks, such as the Internet. The retail transaction can further involve completing a purchase transaction by the RTS 124; and communicating a response message from the RTS 124 to the PMCD 118 indicating that the article 112 has been successfully or unsuccessfully purchased. The purchase transaction can involve using an authorized payment system, such as a bank Automatic Clearing House ("ACH") payment system, a credit/debit card authorization system, or a third party system (e.g., PayPal®, SolidTrust Pay® or Google Wallet®).

The purchase transaction can be completed by the RTS 124 using the article information and payment information. In this regard, such information may be received by a computing device 126 of the RTS 124 and forwarded thereby to a sub-system of a private network 128 (e.g., an Intranet). For example, the article information and purchase information can also be forwarded to and processed by one or more transaction sub-systems 130 to complete a purchase transaction. When the purchase transaction is completed, a message is generated and sent to the PMCD 118 indicating whether the article 112 has been successfully or unsuccessfully purchased.

If the article 112 has been successfully purchased, then a security tag detaching/deactivation process can be started automatically by the RTS 124 or by the PMCD 118. Alternatively, the user (not shown in FIG. 1) can start the security tag detaching/deactivation process by performing a user-software interaction using a keyboard or touchscreen of the PMCD 118. In all three scenarios, the PMCD 118 is used to access security tag information which is available on or in the security tag 106. According to one aspect, the security tag information can be contained in a security tag barcode 108 which is disposed on an exterior housing of the security tag 106. The security tag barcode 108 can be any visible pattern or symbol that contains embedded data. Barcodes may include, for example, one-dimensional barcodes, two dimensional barcodes (such as matrix codes, Quick Response ("QR") codes, Aztec codes and the like), or three-dimensional bar codes.

Figure 2:
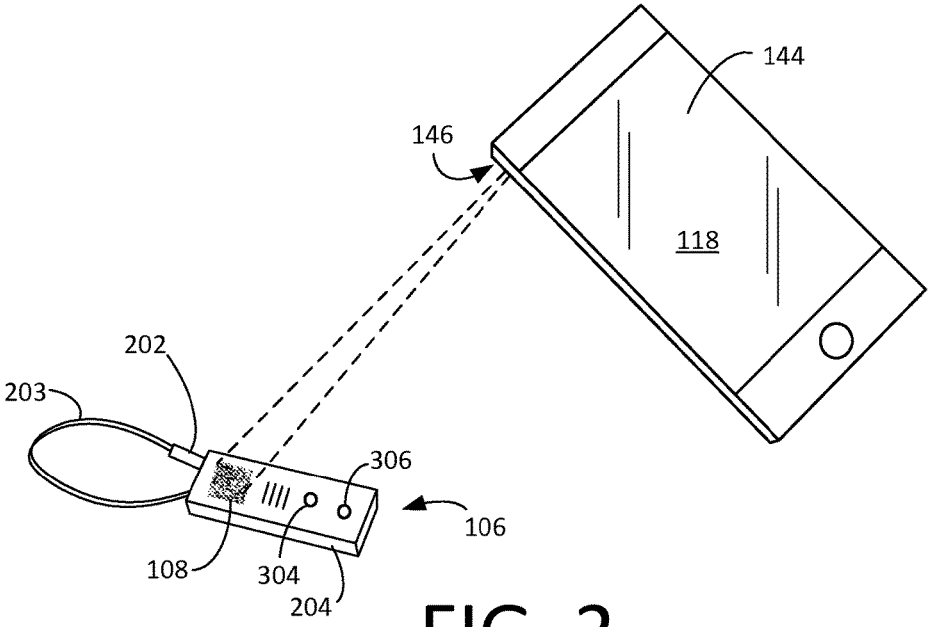
FIG. 2 is an illustration which is useful for understanding how a PMCD can obtain certain security tag information from a barcode disposed on an exterior housing of the security tag.

Referring now to FIG. 2, there is shown an exemplary security tag 106 with a wire loop 203 that is attached at one end to the housing of the security tag and terminated at an opposing end by a pin 202. A barcode is disposed on an exterior of the housing 204 of the security tag. The pin 202 is secured within the housing 204 by a releasable latching mechanism which will be described below in further detail. Although not shown in FIG. 2, the wire loop 203 can be extended through a portion of an article 112 so that the security tag is fixed to the article 112 in a manner that is well known in the art. It should be understood that there are many different types of security tags with many different mechanisms to facilitate their attachment to a particular article. Accordingly, the particular security tag arrangement shown in FIG. 2 is provided merely to facilitate an understanding of the invention. The inventive arrangements described herein can be used with any form of security tag where the tag is attached to an article by means of a releasable pin or other type of releasable element that is held in place by a latching mechanism.

Figure 3:
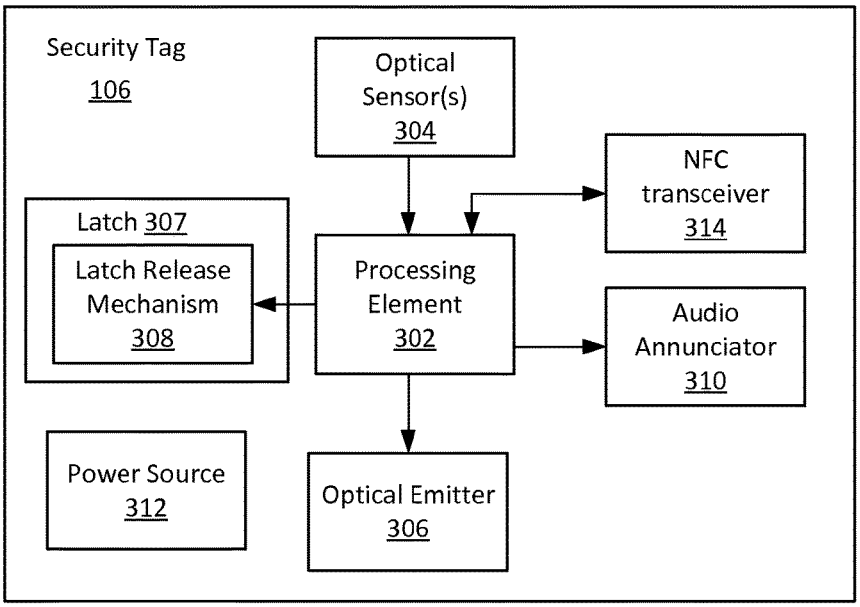
FIG. 3 is a block diagram that is useful for understanding certain aspects of a security tag as described herein.

Referring now to FIG. 3, the security tag 106 can include a processing element 302 to facilitate certain functions relating to security tag detachment operations. The processing element 302 is advantageously selected to be a device with very low power consumption so as to minimize power consumption from an onboard power source 312, such as a battery. Accordingly, the processing element 302 can be implemented as a microprocessor, microcontroller, Field Programmable Gate Array or any other suitable processing element capable of performing the processing functions described herein. The security tag 106 also includes an optical sensor 304 arranged for detecting the encoded optical sequence ("unlock code") produced by the PMCD 118 and communicating such information to the processing element. The security tag 106 also includes a latch 307 which includes latch release mechanism 308. The latch release mechanism is controlled by the processing element 302 for latching and unlatching pin 202. Finally, the security tag 106 can include an optical emitter, such as a Light Emitting Diode (LED), and an audio annunciator 310, both of which are under the control of the processing element 302.

As is well known a camera or imaging device is often provided as part of a PMCD 118. Such camera or imaging device can be used to read the security tag barcode 108. The retail transaction application in the PMCD 118 advantageously includes software or firmware suitable to interpret the barcode 108 and thereby extract the security tag information. After the customer has used the PMCD 118 to scan the security tag barcode and obtain the security tag information, the customer places the PMCD 118 near the security tag 106. The retail transaction application in the PMCD 118 uses the security tag information and a computational algorithm (such as public key encryption) to compute an encrypted unlock code for the security tag. The encryption method used would be adjusted according to the requirements of the application and the practical data transmission limits of an optical link between the mobile device and the tag as described below.

Once the unlock code is computed, the retail transaction application generates an encoded optical sequence ("unlock code") using hardware elements available in the PMCD. For example, the touch screen display of the mobile device can be used for this purpose by alternating a portion of the screen area using the color white and black to form a sequential optical pattern. Alternatively, a camera flash device incorporated into the PMCD 118 can be used to form the alternating optical pattern or sequence during which the flash device is sequentially turned on and off in accordance with a pattern that corresponds to the unlock code. Of course, the invention is not limited in this regard and other light emitting features or attachments provided as part of a PMCD 118 can be modulated by software on the mobile device to produce the desired optical pattern. Regardless of the particular hardware element in the PMCD 118 that is used to form the optical pattern, it is advantageous that the optical sequence should be encoded using a standard serial communication methods and/or symbols to assure accurate and reliable decoding by the anti-theft tag as hereinafter described.

Figure 4:
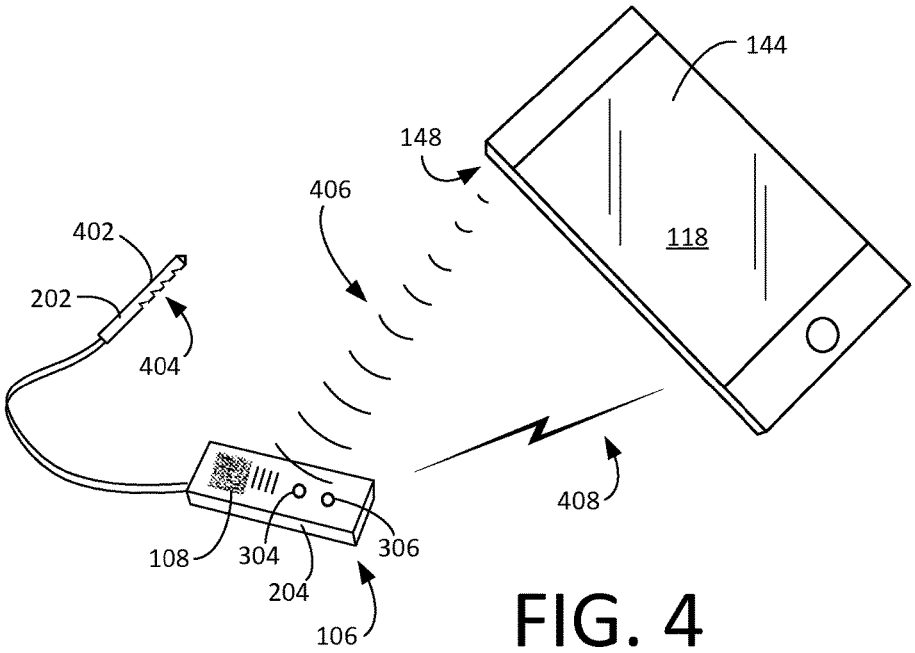
FIG. 4 is an illustration which is useful for understanding how a PMCD can optically communicate an unlock code to a security tag.

As shown in FIG. 4, the processing element 302 in the security tag uses the optical sensor 304 to receive the encoded optical sequence 406 that has been generated by the PMCD 118. If the processing element 302 determines that the encoded optical sequence comprises a valid unlock code, then the processing element causes the latch release mechanism 308 to release a shank 402 of pin 202 that is locked within a cooperating aperture formed in the housing 204 of the security tag 106. For example this can be accomplished by causing a tooth associated with the latch 307 to disengage from one of several grooves 404 disposed in the shank 402. Once the security tag's latch release mechanism is activated, the pin 202 can be removed from the tag body 204 as shown in FIG. 4. Removal of the pin in this manner facilitates detachment of the security tag 106 by the customer from an article 112.

The security tag 106 can be configured such that a customer is notified by a suitable audio or visual signal when the latch release mechanism has been activated using the above-described process. For example, the audio annunciator 310 and/or optical emitter 306 can be used for this purpose. The processing element 302 activates the audio annunciator 310 and/or optical emitter 306 when a correct unlock code has been received and/or the latch release mechanism has been activated so as to visually and/or audibly notify the customer that the tag can be removed.

After the latch release mechanism has been activated, the security tag 106 can remain in this state for a period of time that allows the tag to be removed from an article, after which the latch release mechanism 308 is deactivated and the latch 307 reverts back to a locked state. The purchase transaction and security tag detaching process described herein is repeated for each item in the transaction. Once the security tag 106 has been removed from article 112, the customer 140 can carry the article 112 through the surveillance zone without setting off the alarm.

A barcode disposed on the exterior housing of the security tag is on method to facilitate access to the security tag information necessary for computing an unlock code. However, in some scenarios the security tag 106 may comprise an NFC enabled transceiver device 314. As is known, an NFC communication occurs between NFC enabled devices over a relatively small distance (e.g., N centimeters or N inches, where N is an integer such as twelve). In such a scenario, the NFC communication may be established by touching the PMCD to the security tag 106, or by bringing them in close proximity such that an inductive coupling occurs between inductive circuits thereof. In such a scenario, the PMCD can also include an NFC transceiver as part of the radio frequency communication hardware entities 150. The NFC transceiver will facilitate an NFC communication session so as to request and obtain the security tag information needed to determine a suitable unlock code.

In some scenarios, the NFC operates at 13.56 MHz and at data rates ranging from 120 kilobits per second to 848 kilobits per second. The NFC may be achieved using NFC transceivers configured to enable contactless communication at 13.56 MHz. NFC transceivers are well known in the art, and therefore will not be described in detail herein. Any known or to be known NFC transceivers can be used herein without limitation.

Optical communication of the unlock code is advantageous as it facilitates a relatively simple inexpensive receiving element in the security tag 106 and leverages existing hardware elements in the PMCD 118. However, the inventive arrangements are not necessarily limited to such optical communications methods. For example, in some embodiments, the optical sensor 304 can be replaced or supplemented by a radio frequency receiving element for receiving radio frequency signals 408 communicated by the PMCD 118. A near field communication (NFC) type receiver could be used for this purpose if the PMCD 118 is equipped with an NFC transceiver as part of the radio frequency communication hardware entities 150. The radio frequency signals would comprise a coded message containing the unlock code. In other respects, the security tag with an NFC capability would function in a manner similar to the optical arrangement described herein.

Further, although the inventive arrangements have been described thus far with respect to unlocking and removal of a security tag, it should be appreciated that the invention is not limited in this regard. Instead, the approach described herein can also be utilized to deactivate an EAS element of a security tag attached to an article. Also, it should be understood that although the various embodiments have been described with respect to a retail security anti-theft environment, the invention is not limited in this regard. Instead, the security tag detachment or EAS tag deactivation as described herein can more broadly be understood as pertaining to any type of inventory control scenario where the removal of articles or inventory items from a controlled area is desired. In such a scenario, the right or authorization to remove the inventory article from the controlled area might not necessarily involve a purchase transaction. Instead, the permission to right remove the inventory item or article from the controlled area can be established based on some basis other than a payment transaction. In such scenarios, an authorization transaction can be performed in place of the payment transaction. The authorization transaction can comprise any suitable transaction in which credentials or means other than payment are used as a basis for permitting article removal from a controlled area.

Figure 5A:
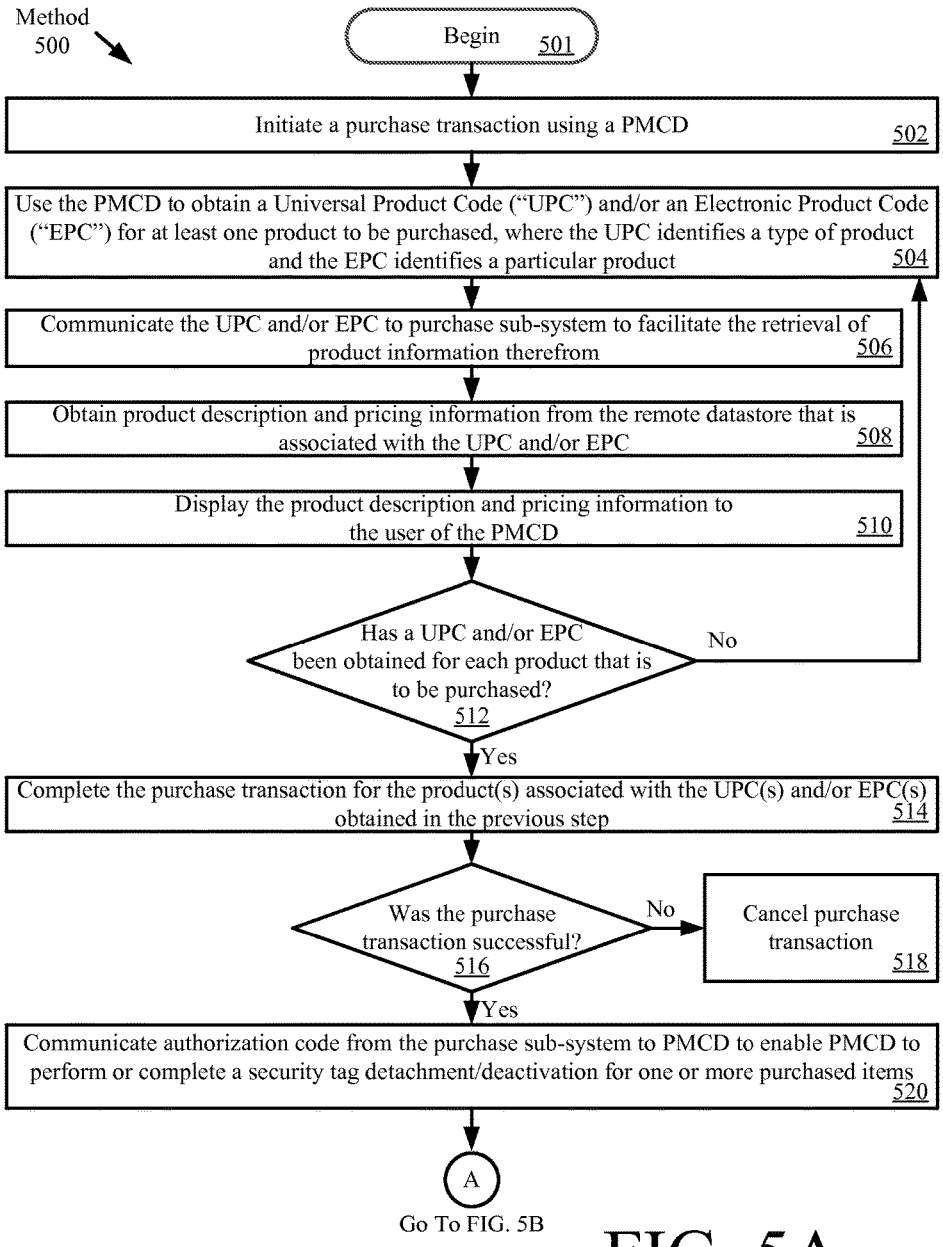
FIGS. 5A through 5C collectively provide a flow diagram of an exemplary method for security tag detachment or deactivation authorization.
Figure 5B:
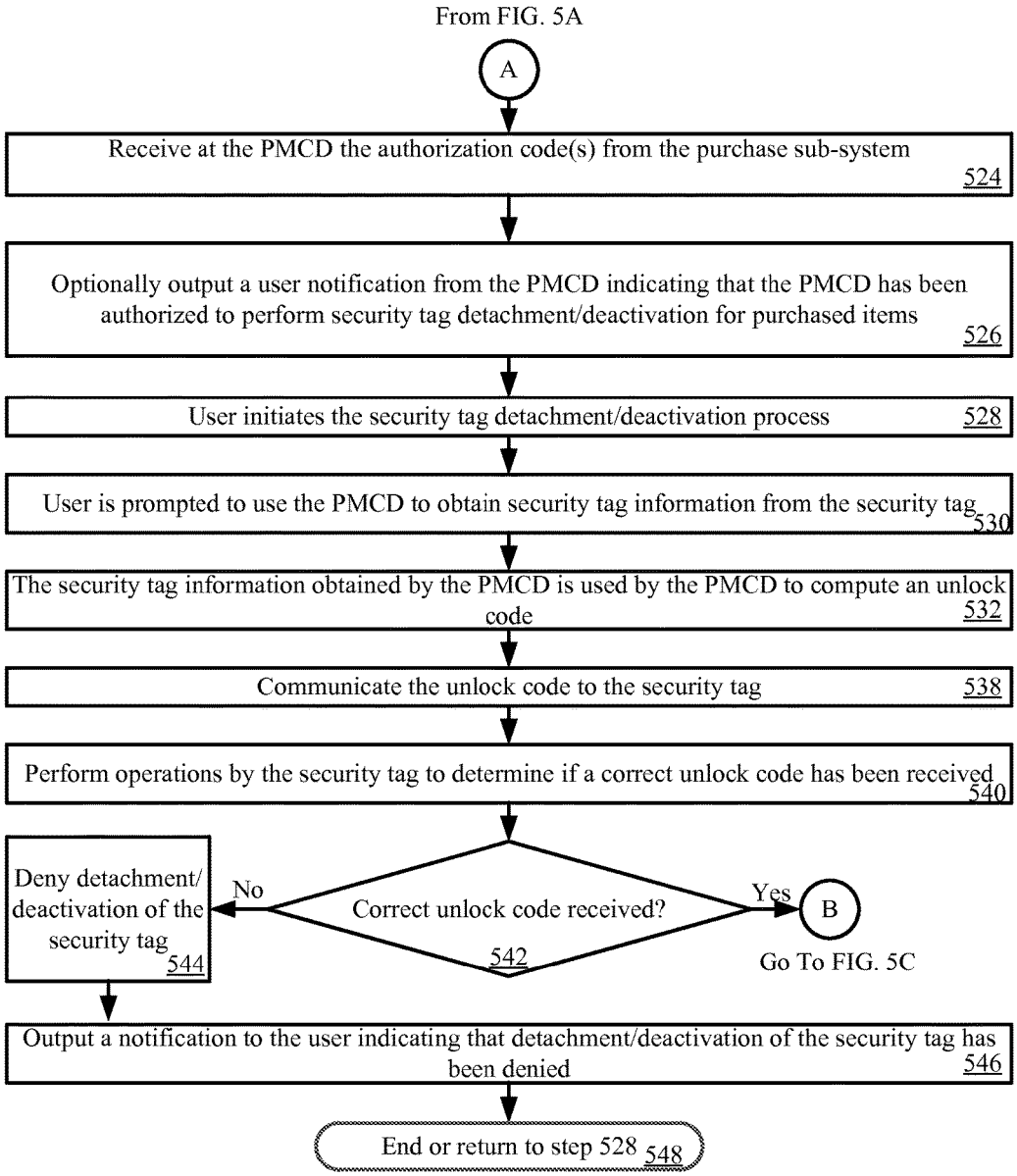
Figure 5C:
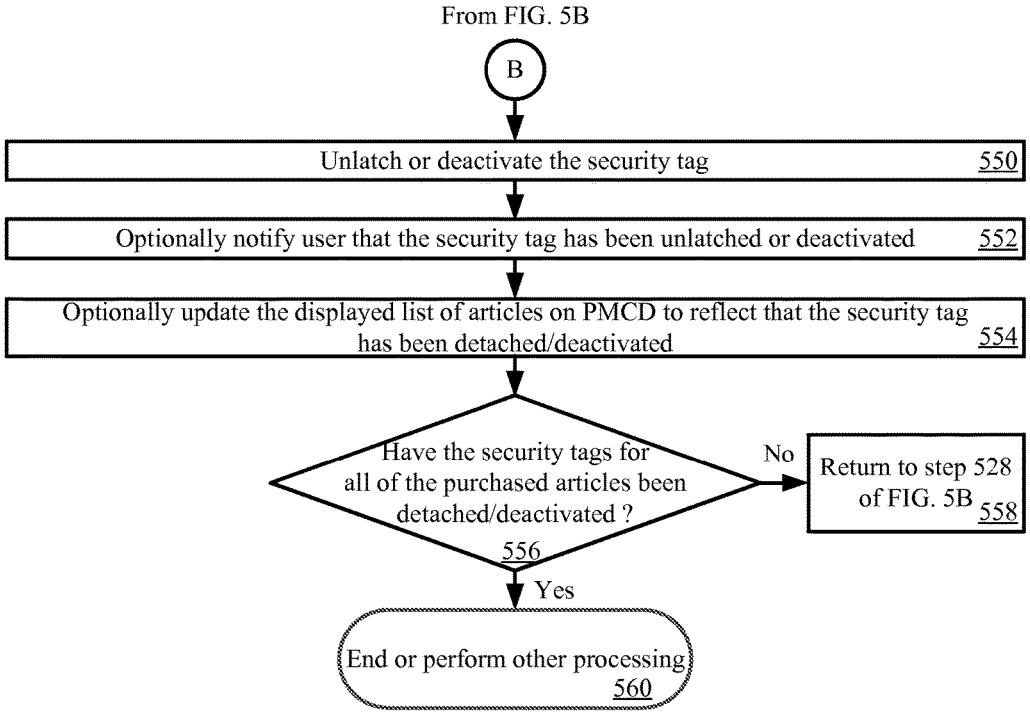

Referring now to FIGS. 5A-5C, there is provided a flow diagram of an exemplary method 500 for security tag detachment or deactivation authorization described herein. As shown in FIG. 5A, method 500 begins with step 501 and continues with step 502 where a purchase transaction (or other similar permission based transaction) is initiated using a PMCD (e.g., PMCD 118 of FIG. 1). Techniques for initiating such a transaction are well known in the art, and therefore will not be described herein. After completing step 502, step 504 is performed where the PMCD is used to obtain a UPC and/or an EPC for at least one product to be purchased. The UPC uniquely identifies a type of product. The EPC uniquely identifies a particular product. The UPC and/or EPC can be obtained using one or more scanning technologies as is known. The scanning technologies include, but are not limited to NFC technology and/or barcode technology.

The UPC and/or EPC is then communicated to a purchase sub-system (e.g., transaction sub-system 130 of FIG. 1) to facilitate the retrieval of product information therefrom, as shown by step 506. In this regard, the purchase sub-system may comprise or have access to a remote datastore in which product information was pre-stored. The product information includes, but is not limited to, product descriptions and purchase prices. The purchase sub-system then uses the UPC and/or EPC to obtain any associated product description and pricing information from the remote datastore, as shown by step 508. The product description and pricing information is communicated in step 510 to the PMCD so that it can be displayed to the user thereof.

At this time, a decision step 512 is performed to determine whether a UPC and/or EPC has (have) been obtained for each product that is to be purchased. If a UPC and/or EPC has(have) not been obtained for each product that is to be purchased [512:NO], then method 500 returns to step 504. In contrast, if the UPC and/or EPC has(have) been obtained for each product that is to be purchased [512:YES], method 500 continues with step 514. Step 514 involves completing the purchase transaction for the product(s) associated with the UPC(s) and/or EPC(s) previously obtained. If the purchase transaction was not successful [516:NO], then step 518 is performed where the purchase transaction is canceled. If the purchase transaction was successful [516:YES], then step 520 is performed to facilitate a security tag detachment/deactivation process.

Step 520 involves communicating from the transaction sub-system to the PMCD a tag detachment or deactivation authorization code which enables the PMCD to perform or complete a security tag detachment or deactivation with respect to one or more purchased items. One authorization code can be provided for each UPC and/or EPC corresponding to an article that has been successfully purchased. According to one aspect, the authorization code is an unlock code for a security tag that can be used by the PMCD to generate an encrypted unlock code which is communicated to the security tag as described below. However, the invention is not limited in this regard and the authorization code can be a simple acknowledgment that the PMCD is now authorized to generate or compute an unlock code. In such a scenario, a standard unlock code could be used for all security tags, but such unlock code will be encrypted in accordance with a public key information which is obtained directly from the security tag. The security tag can then use a private key to decrypt the unlock code to determine if it is valid.

In some embodiments, the authorization code for each security tag can be provided in association with a particular UPC and/or EPC to identify the particular purchased article for which authorization for tag removal/deactivation has been received. Step 520 is performed so that the PMCD has knowledge of the particular articles which (a) have been successfully purchased and (b) have security tags that need to be deactivated or detached therefrom. It is also performed as a security measure so as to selectively limit the circumstances and conditions under which the PMCD can facilitate detachment and/or deactivation of a security tag.

Upon completing step 520, method 500 continues with step 524 of FIG. 5B. As shown in FIG. 5B, step 524 involves receiving the authorization code at the PMCD from the transaction sub-system. Next in optional step 526, a notification is output from the PMCD. The notification indicates that the authorization code has been successfully received from the transaction sub-system and/or that the user is now authorized to use the PMCD to perform security tag detachment/deactivation actions. In response to the notification, the user optionally initiates the security tag detachment/deactivation in step 528. For example, the process can be initiated upon receiving a user input on the PMCD indicating that the user is ready to begin the security tag detachment/deactivation process.

In a next step 530, the user is prompted use the PMCD to obtain security tag information from the security tag by moving the PMCD closer to the security tag. The user can also be prompted to use an imager that is integrated into the PMCD and/or NFC hardware elements provided in the NFC to obtain the security tag information. If an imager is used, this process can involve imaging and then decoding a barcode disposed on the exterior of the security tag housing. If NFC hardware elements are available in the PMCD and security tag, then this process can involve using such hardware elements in the PMCD to interrogate the security tag for the security tag information. The process can further involve using NFC to receive such information from the security tag. Once received, the security tag information is used by the PMCD at 532 to compute an encrypted unlock code. The encrypted unlock code can be unique to the particular security tag for which the information has been obtained. In the case of a security tag to be detached, the encrypted unlock code will cause unlatching or unlocking of the security tag to facilitate detachment of the tag from an article when the code is received in the security tag. In the case of a security tag to be deactivated, the encrypted unlock code will cause the security tag to be inactivated.

At 538 the encrypted unlock code is communicated to the security tag using an optical communication protocol or NFC type communication protocol. Thereafter, at 540 the security tag performs operations to determine if a correct unlock code has been received. If the correct unlock code has not been received [542:NO], then steps 544-546 are performed. These steps involve: denying the detachment/deactivation of the security tag; and outputting a message to the user indicating that the security tag's detachment/deactivation has been denied. Subsequently, step 548 is performed where method 500 ends or returns to step 528.

If the unlock code does match the unlock code stored in firmware of the security tag [242:YES], then method 500 continues with steps 550-554 of FIG. 5C. These steps involve activating the latch release mechanism at 550 to allow the tag to be detached. Alternatively, in the case where the security tag is being deactivated, the unlock code is used to cause deactivating of the security tag. In step 552, the user can optionally be notified that the security tag has been unlatched or deactivated. This can be accomplished by using the tag to signal with an audio annunciator or an optical emitter. In some scenarios, the PMCD can configured detect such notification and will respond by updating a list of purchased articles on the PMCD to reflect that the security tag has been detached or deactivated.

Upon completing step 554, a decision step 556 is performed to determine whether the security tags for all of the purchased products have been detached/deactivated. If all of the security tags have not been detached/deactivated [556: NO], then step 558 is performed where method 500 returns to step 528. In contrast, if all of the security tags have been detached/deactivated [556:YES], then step 560 is performed where method 500 ends or other processing is performed.

The transmission of the encrypted unlock code between the PMCD and the security tag will advantageously involve use of a public key encryption scheme to prevent security attacks (such as thieves attempting to capture unlock codes as they are transmitted to the security tag, then using the unlock code to remove other security tags). Asymmetric key encryption can be used to allow the application software in the PMCD to encrypt valid unlock codes where only the security tag which holds the private key (in its firmware) can decrypt the unlock command. According to one aspect, the security tag information obtained by the PMCD from the security tag's barcode is that tag's public key. Accordingly, the PMCD obtains the public key by reading the barcode identifier on the security tag. The security of this system relies on keeping the private key of each security tag secret. This would be accomplished by embedding the tag's private key securely in the firmware of the tag.

It is conceivable that a person utilizing the inventive arrangements could seek to circumvent certain theft prevention features of an EAS system. For example, a person could conceivably purchase a low cost item in order to obtain a "detach" authorization from a transaction system (e.g. retail transaction system 124), and then use this authorization to detach a tag attached to a higher priced item. There are several options for preventing such a scenario.

According to one aspect, when the security tag is applied to an inventory item by an agent or employee of the controlled facility (e.g. retail store), a scanning process would be performed. The scanning process would acquire the UPC/EPC data for the item and the security tag information for the particular security tag that is attached to the item. This information is then stored in a database 132 in a manner so as to associate the security tag information to the UPC/EPC data for the item to which the tag is attached.

Thereafter, when a customer wishes to remove an item from a controlled area (e.g. a retail store) they will use their PMCD to communicate the security tag information to the retail transaction system. This action can be performed as part of the purchase transaction and/or as part of the tag detachment/disable operations.

Once the security tag information has been received from the PMCD, the transaction system could check the security tag information against the corresponding UPC/EPC stored in the database. The database records will show the UPC/EPC of the item to which the security tag was attached. This particular UPC/EPC linked to the security tag information can then be compared to a list of the purchased items. If the UPC/EPC that is linked to the security tag information does correspond to one of the purchased items, then the transaction system will issue an authorization to the PMCD to facilitate detachment and/or disabling the security tag. As a further security measure, when the authorization code is communicated from the PMCD to the security tag, the public key information from the security tag can be used to encrypt the authorization.

According to a further embodiment, each security tag can have a unique authorization code for detaching and/or disabling the tag. The unique authorization code can be associated with or linked to the security tag information in the transaction system database. When a customer wishes to remove an item from a controlled area (e.g. a retail store) they will use their PMCD to communicate the security tag information to the retail transaction system (or inventory transaction system). This action can be performed as part of the purchase transaction and/or as part of the tag detachment operations. If a transaction is successfully executed, the transaction system will provide an authorization code to unlatch and/or disable the security tag. The authorization code in such scenario will be unique to the particular tag that is attached to the item. More particularly, the transaction system can access the database to associate the security tag information with a corresponding specific authorization code that is needed to unlock the particular security tag. The transaction system can also use this opportunity to verify that the security tag information which has been received from the PMCD in fact corresponds to a security tag that has been attached to an item having the particular UPC/EPC. As a further security measure, when the authorization code is communicated from the PMCD to the security tag, the public key information from the security tag can be used to encrypt the authorization.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

I claim:

1. A method for using a security tag to selectively facilitate the authorized removal from a controlled area of items which have been marked with an item identification code, comprising:

attaching to each item which is disposed in the controlled area a security tag detectable by an Electronic Article Surveillance (EAS) system;

providing a transaction software application for a portable mobile communication device (PMCD) operable to facilitate use of the PMCD to obtain the item identification code, participate in a wireless communication session with a transaction server to receive an authorization for release of the item from the controlled area, access from the security tag a security tag information, use the security tag information to determine an unlock code for the security tag, and wirelessly communicate the unlock code to the security tag after the authorization for release has been received;

wherein the security tag information is a public key; and wherein the PMCD uses the public key to compute an encrypted unlock code which is decodable by the security tag from which security tag information was obtained by using a private key which is stored in the security tag.

2. A security tag for an Electronic Article Surveillance (EAS) system, comprising:

a security tag housing;

a barcode visibly disposed on an exterior of the security tag housing and specifying security tag information;

at least one EAS detection element disposed within the security tag housing and responsive to an EAS system interrogation signal for producing a detectable electromagnetic signature when the security tag is present within an EAS detection zone;

a computer processing device disposed within the security tag housing; and a wireless communication receiver disposed within the housing and operatively coupled to the computer processing device;

wherein the computer processing device is responsive to a coded signal to perform at least one security tag action, the coded signal comprising (a) a code generated using at least a portion of the security tag information specified by the barcode and (b) wirelessly received by the security tag using the wireless communication receiver.

3. The security tag according to claim 2, wherein the security tag further comprises a latch release mechanism responsive to the computer processing device, and wherein the at least one security tag action comprises transitioning the latch release mechanism to an unlatched state to facilitate release of the security tag from an article.

4. A security tag for an Electronic Article Surveillance (EAS) system, comprising:

a security tag housing;

a barcode visibly disposed on exterior of the security tag housing specifying security tag information;

at least one EAS detection element disposed within the security tag housing and responsive to an EAS system interrogation signal for producing a detectable electromagnetic signature when the security tag is present within an EAS detection zone;

a computer processing device disposed within the security tag housing; and a wireless communication receiver disposed within the housing and operatively coupled to the computer processing device;

wherein the computer processing device is responsive to a coded signal determined in accordance with the security tag information and received using the wireless communication receiver to perform at least one security tag action;

wherein the security tag further comprises a latch release mechanism responsive to the computer processing device, and wherein the at least one security tag action comprises transitioning the latch release mechanism to an unlatched state to facilitate release of the security tag from an article; and wherein the computer processing device is configured to cause the latch release mechanism to remain in the unlatched state for a predetermined period of time before automatically causing the latch release mechanism to revert to a latched state.

5. The security tag according to claim 2, wherein the EAS detection element is configured to be selectively disabled responsive to the computer processing device, and wherein the at least one security tag action comprises disabling the EAS detection element to facilitate the removal of the security tag from an EAS controlled area.

6. A security tag for an Electronic Article Surveillance (EAS) system, comprising:

a security tag housing;

a barcode visibly disposed on exterior of the security tag housing specifying security tag information;

at least one EAS detection element disposed within the security tag housing and responsive to an EAS system interrogation signal for producing a detectable electromagnetic signature when the security tag is present within an EAS detection zone;

a computer processing device disposed within the security tag housing; and a wireless communication receiver disposed within the housing and operatively coupled to the computer processing device;

wherein the computer processing device is responsive to a coded signal determined in accordance with the security tag information and received using the wireless communication receiver to perform at least one security tag action;

wherein the coded signal is encrypted using a public key specified by the security tag information.

7. The security tag according to claim 6, wherein the security tag includes a private key stored in a data memory of the security tag to decrypt the coded signal.

8. The security tag according to claim 2, wherein the wireless communication receiver is an optical receiver that is operable for receiving the coded signal in an optical format.

9. The security tag according to claim 2, further comprising at least one of an optical emitter and an audio annunciator responsive to the computer processing device.

10. The security tag according to claim 9 wherein the computer processing device is configured to use at least one of the optical emitter and the audio annunciator to signal that the at least one security tag action has been performed.

11. A security tag for an Electronic Article Surveillance (EAS) system, comprising:

a security tag information dissemination device configured to facilitate short range wireless communication of security tag information to a portable mobile communication device;

at least one EAS detection element responsive to an EAS system interrogation signal for producing a detectable electromagnetic signature when the security tag is present within an EAS detection zone;

a computer processing device;

a wireless communication receiver operatively coupled to the computer processing device; and a latch release mechanism;

wherein the computer processing device is responsive to a coded signal to actuate the latch release mechanism, the coded signal comprising (a) a code generated using at least a portion of the security tag information and (b) wirelessly received from the portable mobile communication device using the wireless communication receiver.

12. The security tag according to claim 11, wherein the security tag information dissemination device is selected from the group consisting of a barcode affixed to an exterior of a housing of the security tag and a near field communication (NFC) device.

13. The security tag according to claim 11, wherein the wireless communication receiver is an optical receiver that is operable for receiving the coded signal in an optical format.

* * * * *